US008370980B2

(12) United States Patent
Minayoshi et al.

(10) Patent No.: US 8,370,980 B2
(45) Date of Patent: Feb. 12, 2013

(54) DRUM TYPE WASHING MACHINE

(75) Inventors: Hiroko Minayoshi, Kyoto (JP); Eiji Matsuda, Hyogo (JP); Kiyonobu Yoshida, Nara (JP); Haruo Ida, Osaka (JP); Yukihiro Kitazaki, Hyogo (JP)

(73) Assignee: Panasonic Corporation, Osaka (JP)

( * ) Notice: Subject to any disclaimer, the term of this patent is extended or adjusted under 35 U.S.C. 154(b) by 834 days.

(21) Appl. No.: 11/838,480

(22) Filed: Aug. 14, 2007

(65) Prior Publication Data

US 2007/0289612 A1 Dec. 20, 2007

Related U.S. Application Data

(62) Division of application No. 10/436,694, filed on May 13, 2003, now abandoned.

(30) Foreign Application Priority Data

Aug. 30, 2002 (JP) ..... 2002-254357

(51) Int. Cl.
*D06F 33/02* (2006.01)

(52) U.S. Cl. ..... 8/158

(58) Field of Classification Search ..... 8/158
See application file for complete search history.

(56) References Cited

U.S. PATENT DOCUMENTS

| | | | |
|---|---|---|---|
| 2,182,655 | A | 12/1939 | Bowen |
| 3,473,175 | A | 10/1969 | Sieber |
| 3,608,339 | A | 9/1971 | Mazza |
| 4,112,590 | A | 9/1978 | Muller |
| 5,107,606 | A | 4/1992 | Tsubaki et al. |
| 5,307,649 | A | 5/1994 | Lim et al. |
| 5,768,730 | A | 6/1998 | Matsumoto et al. |
| 6,557,383 | B1 | 5/2003 | Ito et al. |
| 6,812,657 | B2 | 11/2004 | Raimondi |

FOREIGN PATENT DOCUMENTS

| | | | | |
|---|---|---|---|---|
| CN | 87102092 | A | | 7/1998 |
| CN | 98814198 | C | | 2/2004 |
| DE | 3631685 | | * | 3/1988 |
| EP | 0373063 | A1 | * | 6/1990 |
| EP | 0677609 | A2 | * | 10/1995 |
| EP | 1 063 340 | A1 | | 12/2000 |
| JP | 2002273093 | A | * | 9/2002 |

* cited by examiner

*Primary Examiner* — Michael Barr
*Assistant Examiner* — Jason Riggleman
(74) *Attorney, Agent, or Firm* — RatnerPrestia

(57) ABSTRACT

A drum type washing machine includes a rotating drum having a rotating axis in a substantially horizontal direction and sustained rotatably in a tub. The washing machine further includes a motor for driving the rotating drum, a water supply for supplying water into the tub, and a controller for washing, rinsing and liquid-extracting by controlling workings of the motor. The controller of the washing machine washes a laundry by pouring detergent bubbles in the washing process.

4 Claims, 8 Drawing Sheets

FIG. 2F (not continuously)

DRUM TYPE WASHING MACHINE

This application is a divisional of U.S. patent application Ser. No. 10/436,694, filed May 13, 2003, which is incorporated herein by reference.

1. FIELD OF THE INVENTION

The present invention relates to a drum type washing machine for washing a laundry, such as clothes or textiles, in a rotating drum by controlling washing, rinsing, liquid-extracting and so on.

2. BACKGROUND ART

FIG. 8 shows a sectional view of a conventional drum type washing machine, and FIG. 9 shows a block diagram of the conventional drum type washing machine. As shown in FIGS. 8 and 9, a rotating drum 1 has a plurality of perforations 2 on its outer circumference and is rotatably disposed in a tub 3. A rotating shaft 4 is located substantially horizontal to a rotating axis of the rotating drum 1. A motor 5 is connected to the rotating shaft 4 and rotates the rotating drum 1. A few protrusions 6 are formed at an inner wall of the rotating drum 1.

The tub 3 is sustained in a cabinet 7 by a spring means 8. One end of a drain hose 9 is connected to a lower part of the tub 3, and another end of the drain hose 9 is connected to a drain pump 10, thereby draining used water. A feed valve 11 supplies water into the tub 3, and a water level detecting means 12 detects a water level in the tub 3.

A controller 13 having a controlling means 14, which is formed of a micro-computer, operates the motor 5, the drain pump 10, the feed valve 11 and the like via a power switching means 15, thereby controlling sequential processes such as washing, rinsing or liquid-extracting. An operating course and the like is inputted by an inputting means 16. The controlling means 14 displays information at a display means 17, based on information from the inputting means 16, thereby informing an operator of the inputted information. A memory 18 stores necessary data in order for the controlling means 14 to control. The reference numeral 19 denotes a power source, and the reference numeral 20 denotes a power switch.

An operation of a washing process is described hereinafter. After a laundry, such as clothes or textiles, and detergent are put into the rotating drum 1, the washing process starts by pushing a power source button and a start button (not shown). Then the feed valve 11 supplies water. When the water level detecting means 12 detects a predetermined water level N1, the motor 5 drives. When the water level detecting means 12 detects a predetermined water level N2, supplying water is stopped. The water level N2 is not lower than the water level N1.

In the washing process, the laundry absorbs water, therefore water is supplied to the rotating drum 1. While water is supplied, the rotating drum 1 rotates in normal direction, stops, rotates in reverse direction and stops using the motor 5 at a predetermined number of revolutions and a predetermined time. The laundry is caught on the protrusions 6, lifted and fallen in water from around an upper side of the rotating drum 1. By this working mentioned above, detergent is gradually dissolved in water to create washing liquid, whereby the washing liquid acts on stains of the laundry. After the washing process is finished, the drain pump 10 drains the washing liquid in the tub 3.

As discussed above, the conventional drum type washing machine washes the laundry using mechanical force, while detergent in the rotating drum 1 is dissolved by rotating in a first direction, stopping, rotating in a reverse direction and stopping of the rotating drum 1.

However, the conventional drum type washing machine does not use much water. Thus, much time may be required for dissolving the detergent and for getting the laundry wet uniformly by detergent water. As a result, unevenness caused by washing occurs, detergency deteriorates or washing time becomes longer.

SUMMARY OF THE INVENTION

A drum type washing machine includes the following elements:

(a) a rotating drum having a rotating axis in a substantially horizontal direction, and sustained rotatably in a tub, (b) a motor for driving the rotating drum, (c) a water supplying means for supplying water into the tub, and (d) a controlling means for washing, rinsing and liquid-extracting by controlling workings of the motor Thus, laundry such as clothes or textiles is washed by pouring detergent bubbles in the washing process.

As a result, the drum type washing machine decreases unevenness caused by washing, improves detergency and shortens washing time, even with low amounts of supplied water.

BRIEF DESCRIPTION OF THE DRAWINGS

FIGS. 2B-2F are illustrations which are useful for explaining operation of the first embodiment.

DETAILED DESCRIPTION OF THE INVENTION

Figure 8:
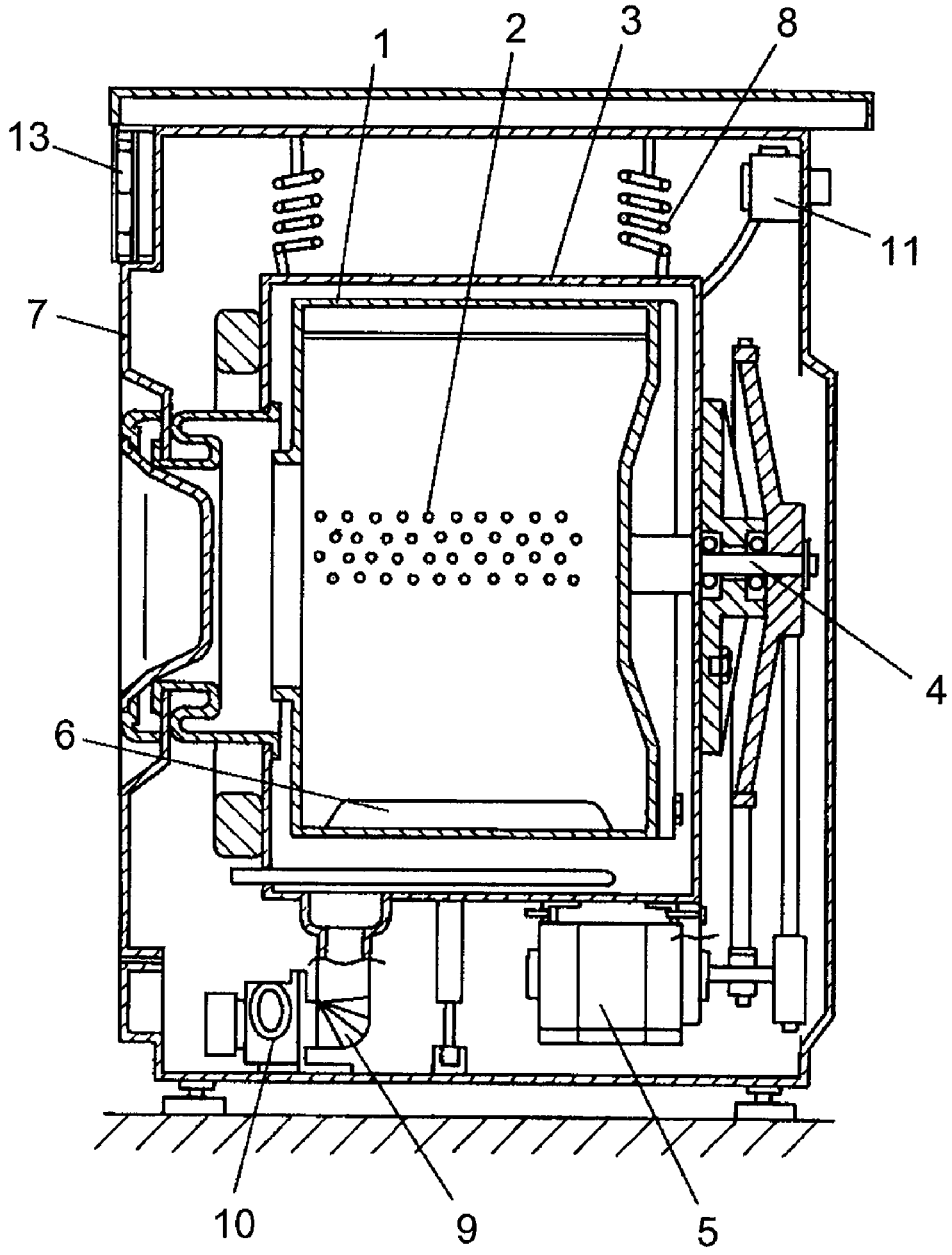
FIG. 8 PRIOR ART
FIG. 8 shows a sectional view of a conventional drum type washing machine.
Figure 9:
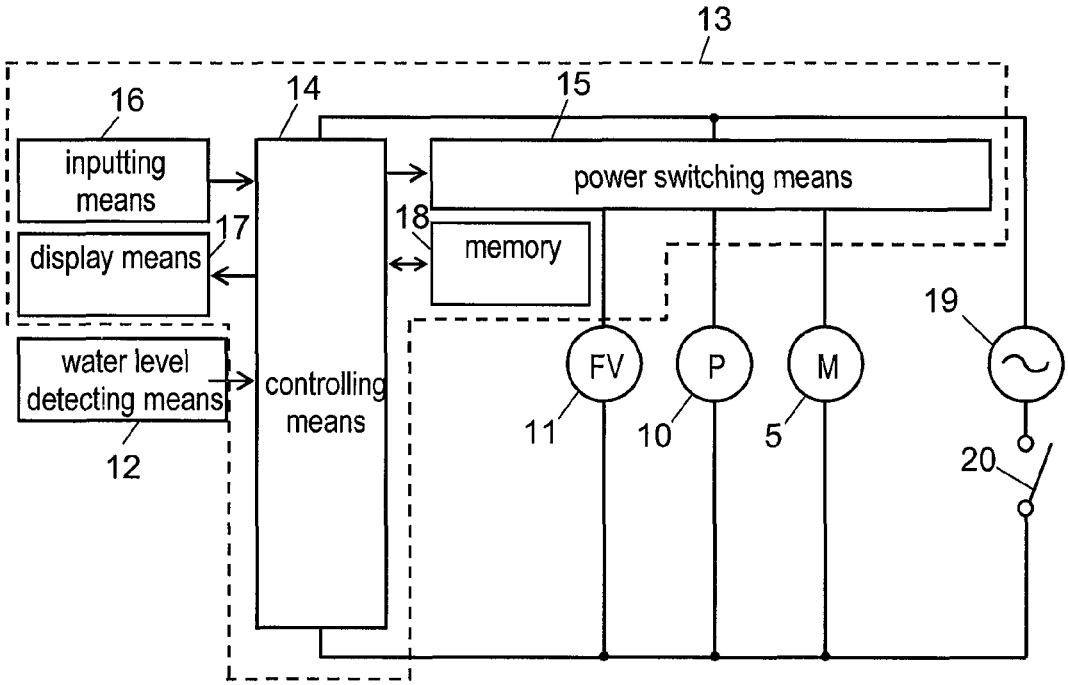
FIG. 9 PRIOR ART
FIG. 9 shows a block diagram of the conventional drum type washing machine.

Exemplary embodiments of the present invention are demonstrated hereinafter with reference to the accompanying drawings. The elements similar to those shown in a conventional drum type washing machine of FIGS. 8 and 9 have the same reference marks, and the descriptions of those elements are omitted here.

First Embodiment

Figure 1:
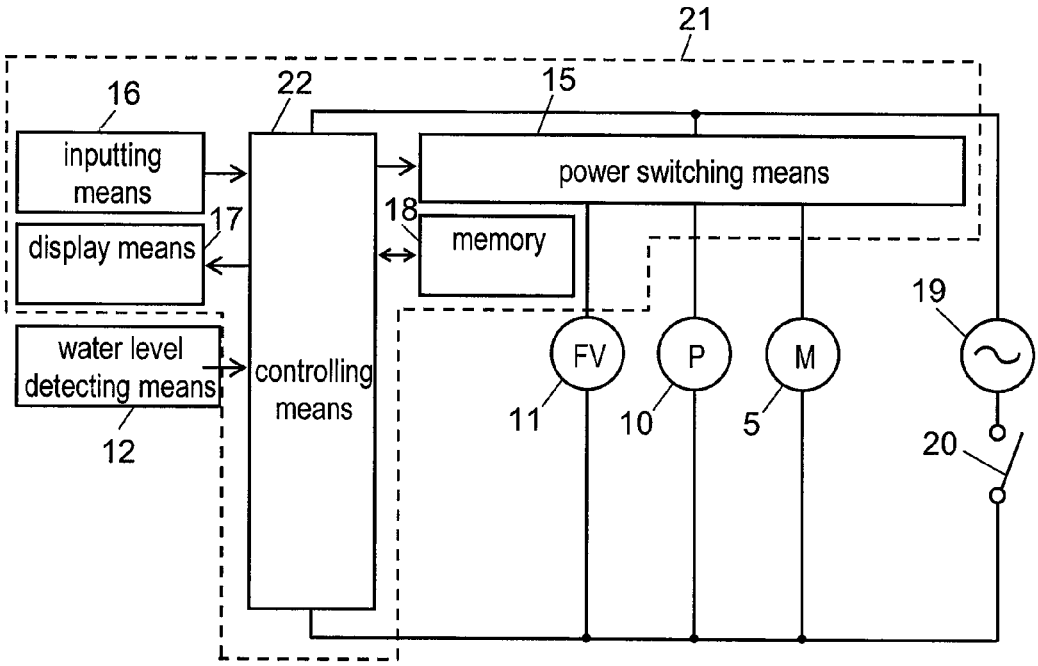
FIG. 1 PRIOR ART
FIG. 1 shows a block diagram of a drum type washing machine in accordance with exemplary embodiments of the present invention.
Figure 2A:
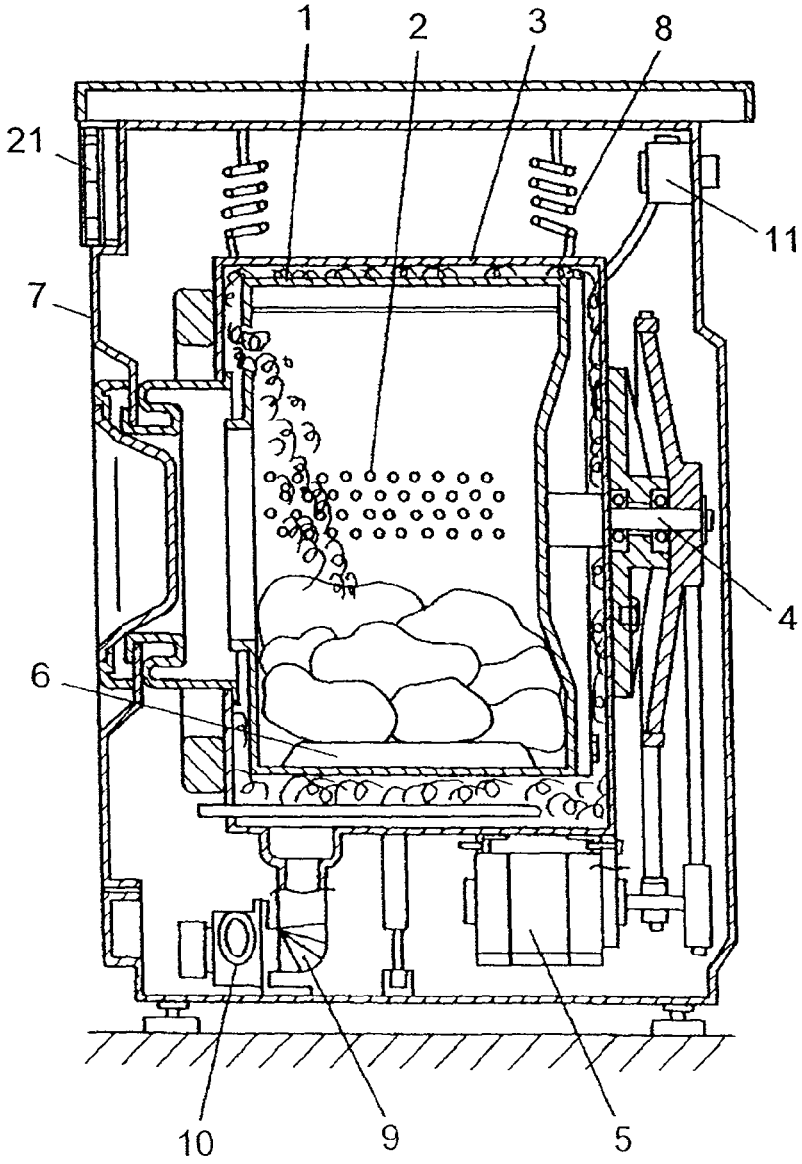
FIG. 2A shows a sectional view of a drum type washing machine in accordance with a first exemplary embodiment of the present invention.

FIG. 1 shows a block diagram of a drum type washing machine in accordance with embodiments of the present invention. FIG. 2A shows a sectional view of the drum type washing machine in accordance with the first exemplary embodiment of the present invention. The left side in FIG. 2 shows a front of the drum type washing machine and the right side in FIG. 2 shows a back of the drum type washing machine.

In FIGS. 1 and 2A, a controller 21 having a controlling means 22, which is formed of a micro-computer, operates a motor 5, a drain pump 10, a feed valve 11 (i.e., water supplying means 11) and the like via a power switching means 15. As a result, the controller 21 controls sequential processes such as washing, rinsing or liquid-extracting, In the washing process, detergent bubbles are poured onto a laundry, such as clothes or textiles, in a rotating drum 1.

Figure 2B:
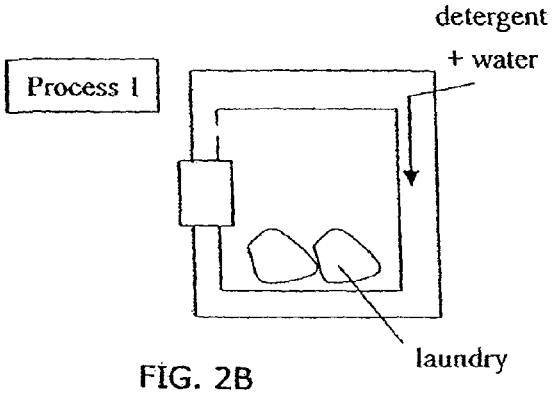

An operation of a washing process is described hereinafter. As shown in FIG. 2B, laundry is put into the rotating drum 1, and detergent is put into a detergent case (not shown). Then the washing process starts, the feed valve 11 supplies water. The supplied water passes through the detergent case, and is inputted into a tub 3 with the detergent. When a water level detecting means 12 detects a predetermined water level N1, the motor 5 drives, so that the rotating drum 1 rotates approximately 50 r/min of the number of revolutions (FIG. 2C). When the water level detecting means 12 detects a predetermined water level N2 (FIG. 2D), supplying water is stopped. The water level N2 is not lower than the water level N1.

Figure 2E:
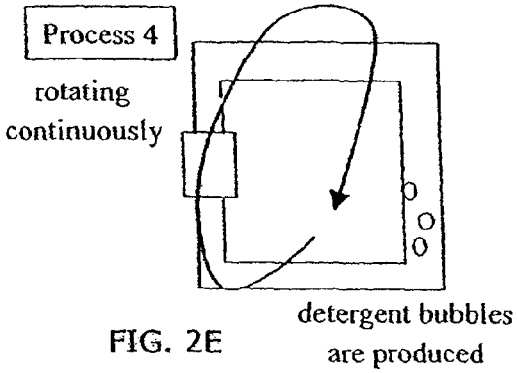
Figure 2C:
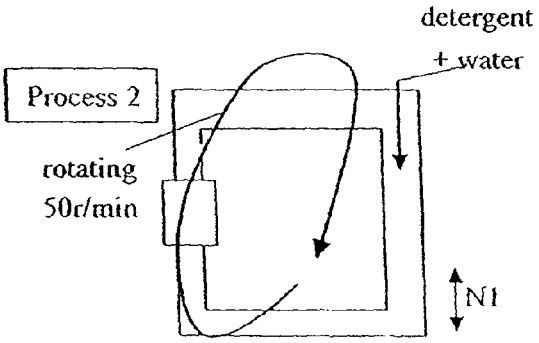
Figure 2D:
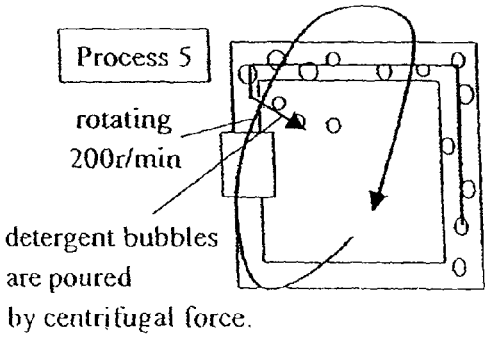
Figure 2D:
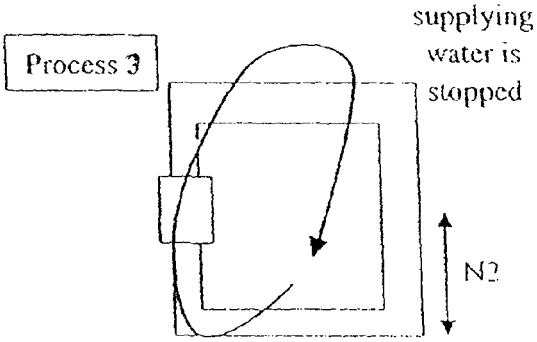

After that, when the rotating drum 1 rotates continuously, washing liquid (i.e., solution of the detergent in water) is stirred by irregularities between the rotating drum 1 and the tub 3, thereby producing detergent bubbles (FIG. 2E). Next, the rotating drum 1 rotates at the number S1 (e.g., 200 r/min) of revolution at which the laundry is clung to an inner wall of the rotating drum 1. Then the produced detergent bubbles rise in space between the rotating drum 1 and the tub 3 by centrifugal force, overflow from a front upper section of the washing machine and are poured onto the laundry in the rotating drum 1 (FIG. 2F).

Figure 3:
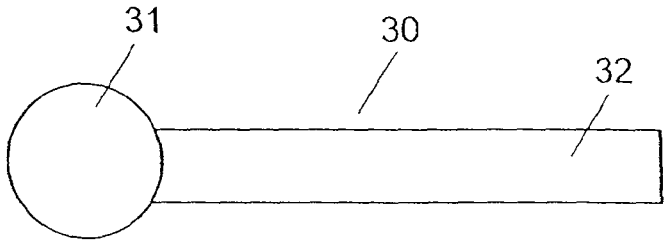
FIG. 3 shows a detergent molecule in accordance with exemplary embodiments of the present invention.
Figure 4:
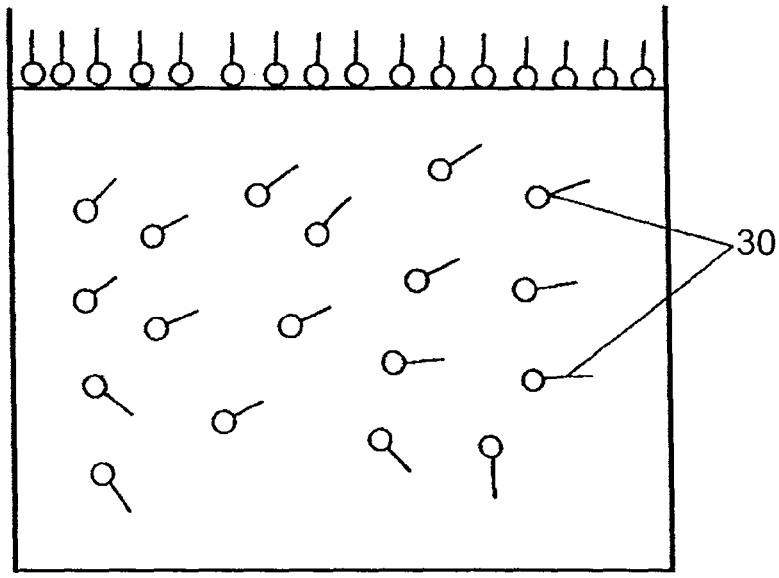
FIG. 4 shows a state where detergent molecules are dissolved in water in accordance with exemplary embodiments of the present invention.

The detergent bubbles are described hereinafter. As shown in FIG. 3, in general, a detergent molecule 30 consists of a hydrophilic group 31 and a lipophilic group 32. As shown in FIG. 4, when the detergent is dissolved in water, the detergent molecules 30 are arrayed on a surface of the water, however, the detergent molecules 30 which can not be arrayed on the surface exist individually or in micelles (group) under the water. Immediately after the surface detergent molecules 30 are removed, the detergent molecules 30 under the water move to the surface of the water, so that the surface of the water is replenished with the detergent molecules 30.

Figure 5:
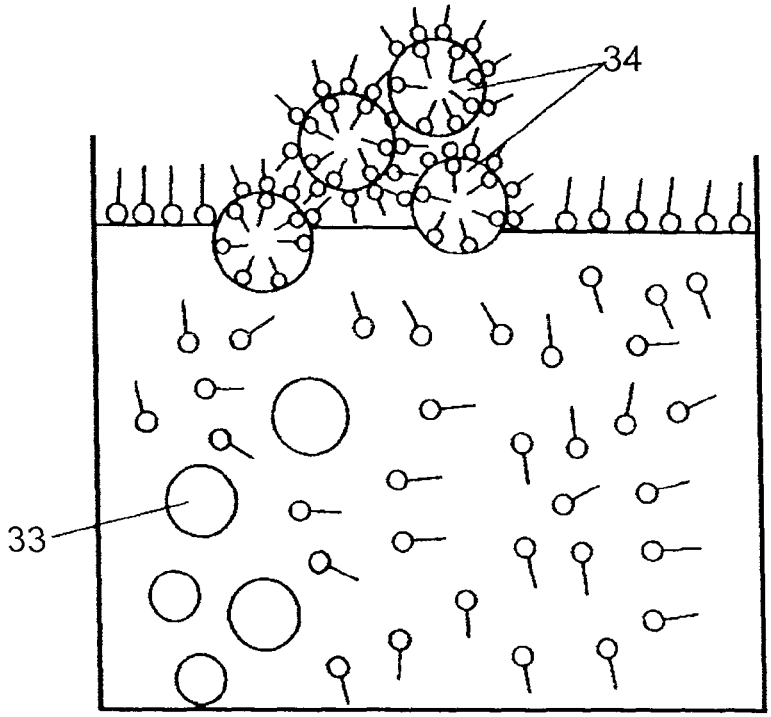
FIG. 5 shows a state where air bubbles are inputted into detergent water in accordance with exemplary embodiments of the present invention.

As shown in FIG. 5, when air bubbles 33 are supplied into detergent water (mixture of the detergent and the water), the air bubbles 33 rise and reach the surface of the water. Then the air bubbles 33 hold the detergent molecules 30, which are arrayed on the surface of the water, thereby creating bubbles 34. The bubbles 34 array as many detergent molecules 30 as possible on its surface, so that the bubbles 34 having high detergent concentration are created. When the detergent molecules 30 on the surface of the water are removed to form the bubbles 34, detergent molecules 30 under the water move to the surface of the water to fill detergent-molecule-less areas. When the air bubbles 33 are supplied continuously, the bubbles 34 are generated one after another. The lipophilic groups 32 are arrayed on the outside of the bubbles 34.

When the bubbles 34 pass through a surface or an inside of the stained laundry, the lipophilic groups 32 combine with stains of oil or stains of particles stuck to oil, so that the stains are removed from the laundry. Additionally, when the bubbles 34 are broken while passing through the laundry, the detergent in concentrated form soaks into the laundry, so that stains can be easily removed.

As discussed above, the detergent bubbles having large volumes are produced from the washing liquid, and poured onto the laundry of the rotating drum 1. Thus, even when the volume of the washing liquid is not much, the detergent effectively acts on stains of the laundry, and the detergent in concentrated form easily soaks into the laundry. As a result, the drum type washing machine of this invention decreases unevenness caused by washing, improves detergency and shortens washing time.

In addition, an air pump for generating bubbles (not shown) and a bubbles ejecting means (not shown) can be disposed at the tub 3, so that detergent bubbles can be generated and poured onto the laundry of the rotating drum 1.

Second Embodiment

Figure 6:
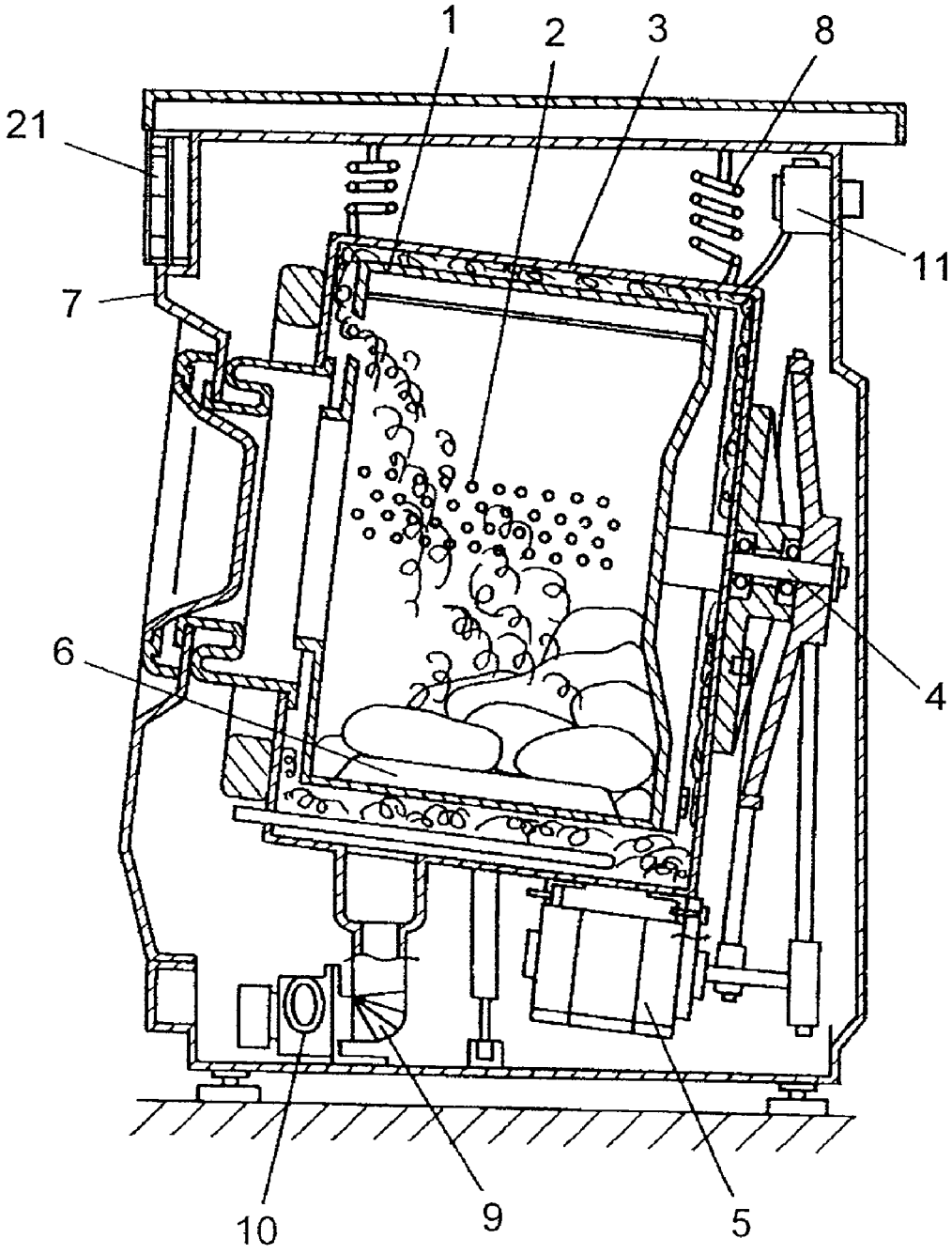
FIG. 6 shows a sectional view of a drum type washing machine in accordance with a second exemplary embodiment of the present invention.

FIG. 6 shows a sectional view of a drum type washing machine in accordance with the second exemplary embodiment of the present invention. The left side in FIG. 6 shows a front of the drum type washing machine and the right side in FIG. 6 shows a back of the drum type washing machine.

As shown in FIG. 6, in the drum type washing machine of the second embodiment, a rotating axis of a rotating shaft 4 of a rotating drum 1 is tilted, whereby a front side of the rotating drum 1 becomes higher than a back side of the rotating drum 1. Other elements are the same as those of the first embodiment, and have the same reference marks, so that the descriptions of those elements are omitted here.

In a washing process, detergent bubbles are poured onto a laundry, such as clothes or textiles, in a rotating drum 1. At that time, the detergent bubbles are poured from the higher position of the rotating axis (i.e., the front side of the rotating drum 1) in a diagonal back direction.

An operation of a washing process is described hereinafter. The detergent bubbles are produced by the same method described in the first embodiment. The detergent bubbles, which are produced by continuous rotation of the rotating drum 1, rise in space between the rotating drum 1 and a tub 3 by centrifugal force, and overflow from a front upper section of the washing machine. The detergent bubbles are poured from the higher position of the rotating axis (i.e., the front side of the rotating drum 1) in a diagonal back direction.

As discussed above, the laundry is clustered at the lower side of the rotating drum 1 by tilting the rotating axis. The detergent bubbles are poured onto the laundry in the rotating drum 1 from the higher position of the rotating axis in a diagonal back direction. The drum type washing machine in this embodiment can pour detergent bubbles onto the laundry wider than a washing machine having a rotating axis in a substantially horizontal direction. Thus, detergent effectively acts on stains of the laundry, and the detergent in concentrated form easily soaks into the laundry. As a result, the drum type washing machine of this invention decreases unevenness caused by washing, improves detergency and shortens washing time.

In addition, an air pump for generating bubbles (not shown) and a bubbles ejecting means (not shown) can be disposed at the tub 3, so that detergent bubbles can be generated and poured onto the laundry of the rotating drum 1.

In this embodiment, the rotating axis is tilted in order for the front side of the rotating drum to be higher than the back side of the rotating drum. However, the rotating axis can be tilted in order for the back side of the rotating drum to be higher than the front side of the rotating drum.

In addition, detergent bubbles are poured from the front upper section of the washing machine in this embodiment, however, detergent bubbles can be poured from a back upper section of the washing machine.

Third Embodiment

In this embodiment, a rotating drum 1 is rotated while detergent bubbles are poured onto a laundry in a washing process. Other elements are the same as those of the first embodiment, and have the same reference marks, so that the descriptions of those elements are omitted here.

An operation of a washing process is described hereinafter. The detergent bubbles are produced by the same method described in the first embodiment. The detergent bubbles produced by continuous rotation of the rotating drum 1 rise in space between the rotating drum 1 and a tub 3 by centrifugal force, and overflow from a front upper section of the washing machine. At that time, the rotating drum 1 is rotated while the detergent bubbles are poured, so that the detergent bubbles are thoroughly poured onto the laundry in the rotating drum 1. After that, the detergent bubbles return to the space between the rotating drum 1 and the tub 3. In other words, the detergent bubbles circulate.

As discussed above, the detergent bubbles are poured while the rotating drum 1 rotates, so that detergent acts on stains of the laundry more uniformly and thoroughly than the case where the rotating drum 1 stops. In addition, the detergent in concentrated form soaks into more laundry. As a result, the drum type washing machine of this invention decreases unevenness caused by washing, and improves detergency.

As the second embodiment, a washing machine having a tilted rotating axis of a rotating shaft 4 of a rotating drum 1 can be also used.

Fourth Embodiment

Figure 7:
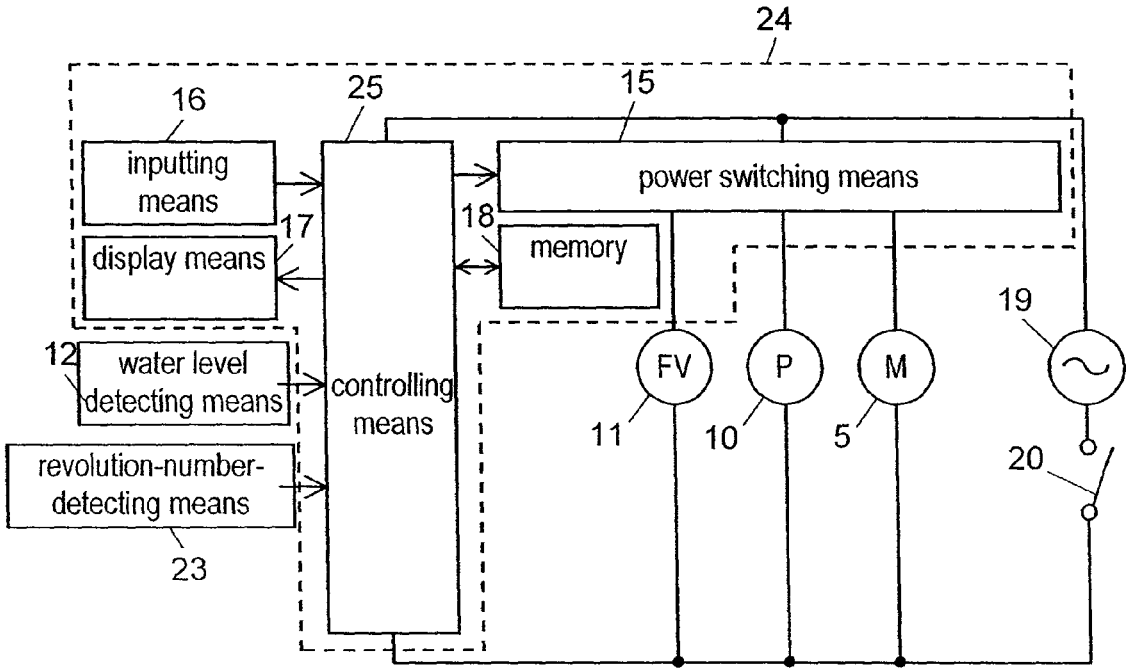
FIG. 7 shows a block diagram of a drum type washing machine in accordance with a fourth exemplary embodiment of the present invention.

FIG. 7 shows a block diagram of a drum type washing machine in accordance with the fourth exemplary embodiment of the present invention.

As shown in FIG. 7, a revolution-number-detecting means 23 detects the number of revolution of a rotating drum 1, and inputs detected information to a controlling means 25 of a controller 24. Detergent bubbles are poured into the rotating drum 1, and the controlling means 25 controls the number of revolution of the rotating drum 1 based on the output of the revolution-number-detecting means 23. Other elements are the same as those of the third embodiment, and have the same reference marks, so that the descriptions of those elements are omitted here.

An operation of a washing process is described hereinafter. The detergent bubbles are produced by the same method described in the third embodiment. The rotating drum 1 rotates, and the detergent bubbles are poured from a front upper section of the washing machine. At that time, the number of revolution is controlled. When the number of revolution becomes high (e.g., 200 r/min), a laundry clings to the rotating drum 1 and the detergent bubbles pass through the laundry, so that the detergent in concentrated form soaks into more laundry. When the number of revolution becomes low (e.g., 50 r/min), each of the laundry rubs each other and rotates in the rotating drum 1. As a result, the detergent bubbles thoroughly act on the laundry and combine with stains of oil or stains of particles stuck to oil, thereby easily removing the stains from the laundry. As discussed above, the drum type washing machine of this invention decreases unevenness caused by washing and improves detergency.

A drum type washing machine having a tilted rotating axis of a rotating shaft 4 of a rotating drum 1, which is discussed in the second embodiment, can be also used.

A washing machine of this invention can use both high number (e.g., 200 r/min) of revolution and low number (e.g., 50 r/min) of revolution of the rotating drum 1 in one washing process.

Fifth Embodiment

In this embodiment, in a state where a laundry is thoroughly covered with bubbles in a rotating drum 1, a rotating drum 1 rotates in normal and reverse direction. Other elements are the same as those of the first embodiment, and have the same reference marks, so that the descriptions of those elements are omitted here.

An operation of a washing process is described hereinafter. Detergent bubbles are produced by the same method described in the first embodiment. The detergent bubbles are poured into the rotating drum 1, and the laundry is thoroughly covered with bubbles. At that time, the rotating drum 1 is rotated in normal and reverse direction, thereby providing the laundry with mechanical force.

In a state where the laundry is thoroughly covered with bubbles, mechanical force acts on the laundry, whereby the detergent bubbles thoroughly come into contact with stains of the laundry. Thus the detergent bubbles combine with more stains of oil or stains of particles stuck to oil, thereby removing the stains from the laundry. In addition, the detergent in concentrated form soaks into more laundry. As a result, the drum type washing machine of this invention decreases unevenness caused by washing and improves detergency.

As the second embodiment, a washing machine having a tilted rotating axis of a rotating shaft 4 of a rotating drum 1 can be also used.

In addition, as the third embodiment, a rotating drum 1 can rotate while detergent bubbles are poured. Further, as the forth embodiment, the number of revolution of the rotating drum 1 can be controlled while detergent bubbles are poured.

What is claimed is:

1. A method of washing laundry, the method comprising;

supplying water to a tub in which a rotating drum containing the laundry is disposed;

spinning the rotating drum at a first number of revolutions for producing detergent bubbles between the rotating drum and the tub; and spinning the rotating drum at a second number of revolutions higher than the first number of revolutions, and at a sufficient speed to cause the detergent bubbles to rise between the rotating drum and the tub by centrifugal force so that the rising detergent bubbles are in contact with the rotating drum and in order to pour the detergent bubbles onto the laundry in the rotating drum.

2. The method according to claim 1, wherein the second number of revolutions is at least 200 rotations per minute.

3. The method according to claim 1, wherein the number of revolutions of the rotating drum is controlled while the detergent bubbles are poured into the rotating drum.

4. The method according to claim 1, wherein the rotating drum rotates in a normal direction and a reverse direction in a state where the laundry in the rotating drum is covered with bubbles.

* * * * *